United States Patent [19]

Uehara

[11] 4,303,264

[45] Dec. 1, 1981

[54] WINDOW LATCH

[75] Inventor: Takeo Uehara, Uozu, Japan

[73] Assignee: Yoshida Kogyo K.K., Tokyo, Japan

[21] Appl. No.: 66,316

[22] Filed: Aug. 14, 1979

[30] Foreign Application Priority Data

Aug. 14, 1978 [JP] Japan ..... 53-111279[U]

[51] Int. Cl.[3] ..... E05C 9/04

[52] U.S. Cl. ..... 292/7

[58] Field of Search ..... 292/7, 207, 241, 242, 292/333

[56] References Cited

U.S. PATENT DOCUMENTS

| | | | |
|---|---|---|---|
| 2,438,346 | 3/1948 | Mooney | 292/333 |
| 2,674,480 | 4/1954 | Vigmostad | 292/7 |
| 3,599,452 | 8/1971 | Maruyama | 292/333 X |
| 3,600,019 | 8/1971 | Toyota | 292/241 X |

*Primary Examiner*—Richard E. Moore

*Attorney, Agent, or Firm*—Hill, Van Santen, Steadman, Chiara & Simpson

[57] ABSTRACT

A window latch comprises a cam keeper on one meeting window stile and a rotatable latch cam on the other meeting stile for locking engagement with the cam keeper. The latch cam has an actuator shaft operatively connected to a slide plate, which is movable along a straight line in response to rotation of the actuator shaft. The slide plate has a slot and fixed first engaging means. A base plate carries a locking feeler having second engaging means movable transversely of the direction of movement of the slide plate, the second engaging means normally engaging the first engaging means to prevent the movement of the slide plate. The slide plate and hence the latch cam are allowed to move when the locking feeler is pushed by said one meeting window stile to cause the second engaging means to disengage from the first engaging means into the slot.

12 Claims, 10 Drawing Figures

WINDOW LATCH

BACKGROUND OF THE INVENTION

1. Field of the Invention

The present invention relates to a window latch for locking action between a pair of first and second meeting window stiles.

2. Prior Art

FIG. 10 of the accompanying drawings shows an example of a window latch comprising a hook-shaped cam keeper mounted on one of the meeting window stiles and a latch cam rotatably mounted on the other meeting stile for locking engagement with the cam keeper. When it is attempted to close the windows with the latch cam inadvertently remaining in its locking position, the latch cam collides with the cam keeper, with the result that the latch cam, the cam keeper, or both may be deformed, and the meeting stiles may be damaged. Proper latching action, then, cannot be obtained.

Where the window latch is operatively associated with means for shifting window sashes perpendicularly to their planes against the window frame for an increased degree of sealing therebetween, the latch cam includes an actuator shaft of square cross section received in a complementary hole in a mechanism for converting rotational movement of the actuator shaft to straight-line motion to be transmitted to the shifting means. Once the converting mechanism is placed in a meeting stile, it is difficult to ascertain only by looking at the complementary hole whether the mechanism is in its initial position before the latch cam is attached to the meeting stile. It has therefore been time-consuming to connect the converting mechanism properly with the shifting means.

SUMMARY OF THE INVENTION

According to the present invention, a rotatable latch cam has an actuator shaft of a noncircular cross-section engaging a crank plate to which is operatively connected a slide plate movable along a straight line in response to rotation of the cam. The slide plate has a slot extending in the direction of the movement of the slide plate and a recess opening into the slot. A base plate through which the actuator shaft extends has a groove extending transversely of the slot in the slide plate. A locking feeler is slidably disposed in the groove and has a locking flange extending into the slot. The locking feeler is normally urged by spring means to cause the locking flange to be seated in the recess in the slide plate. Movement of the slide plate and rotation of the latch cam are prevented by engagement of the locking flange with a shoulder defined by the recess. The latch cam is allowed to move when the locking feeler is engaged and pushed by the meeting stile of an adjacent closed window sash to enable the locking flange to move out of the recess into the slot. The slide plate has another recess opening into the slot for receiving the locking flange when it is fully pushed back, so as to locate the initial position of the slide plate with respect to the base plate, thereby enabling only correct attachment of the latch cam.

It is an object of the present invention to provide a window latch having means for preventing actuation of a latch cam until the window sashes are fully closed.

Another object of the present invention is to provide a window latch having means for determining the initial position of a slide plate to be coupled with means for shifting a pair of windows perpendicularly to their planes against the window frame for better sealing between the sashes and the frame.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
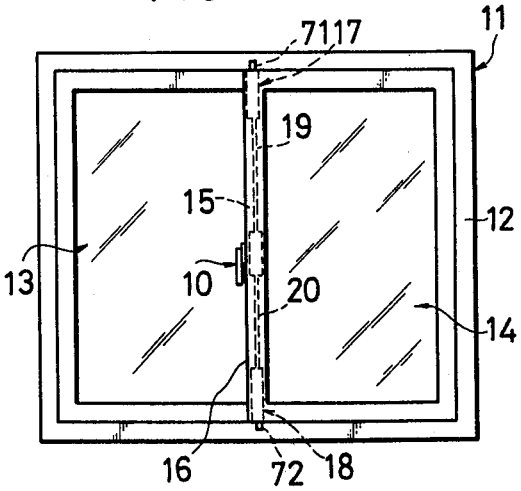
FIG. 1 is a front elevational view of a window assembly to which a latch according to the present invention is attached.
Figure 5:
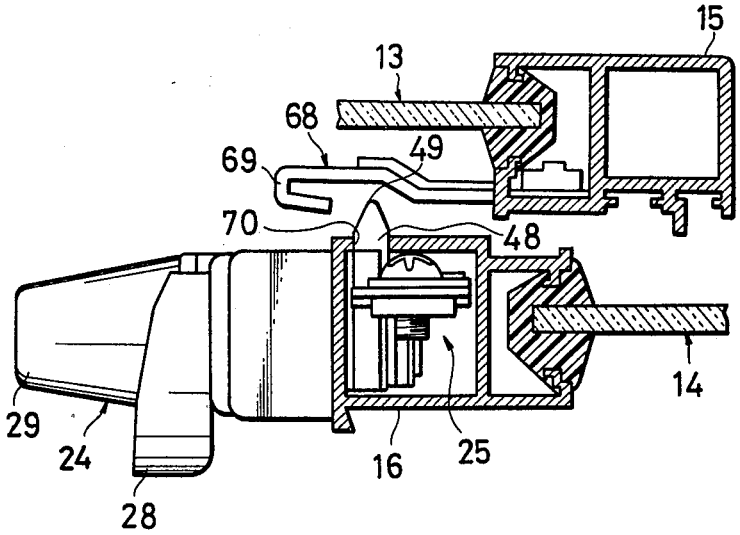
FIG. 5 is an enlarged horizontal cross-sectional view of a pair of window meeting stiles.
Figure 6:
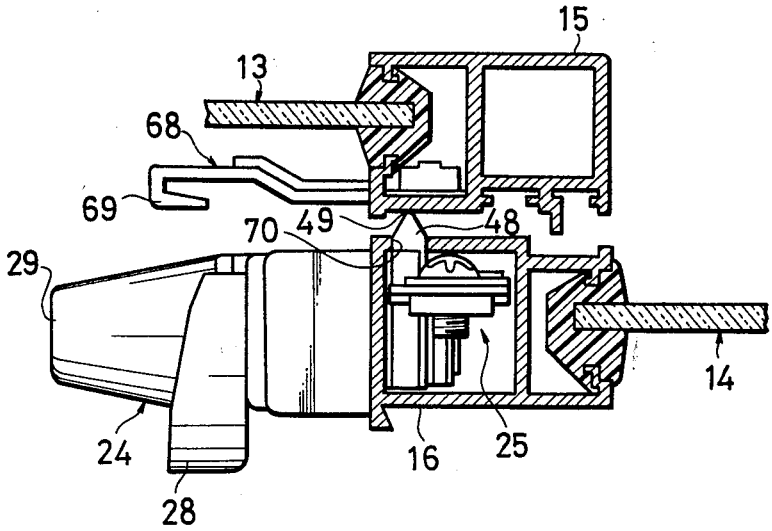
FIG. 6 is a view similar to FIG. 5, showing a locking feeler engaging one of the meeting stiles.

The principles of the present invention are particularly useful when embodied in a latch such as shown in FIG. 1, generally indicated by the numeral 10. The latch 10 is installed on a window assembly 11 comprising a frame 12 to be mounted in a building opening and a pair of window sashes 13, 14 surrounded by and horizontally movable in the frame 12. The window sashes 13, 14 include a pair of vertical meeting stiles 15, 16, respectively, as best shown in FIGS. 5 and 6. When the window sashes 13, 14 are in the closed position, the meeting stiles 15, 16 are held in horizontal alignment or register with each other. Each of the meeting stiles 15, 16 is preferably a hollow aluminum extrusion.

The latch 10 is operatively connected with a pair of upper and lower window shifting devices 17, 18 (FIGS. 1 and 2) disposed in the meeting stile 16. The upper and lower window shifting devices 17, 18 are connected to the latch 10 by means of a pair of upper and lower vertical rods 19, 20, respectively. When the latch 10 is actuated to lock the window sashes 13, 14 together in their closed position, the upper and lower window shifting devices 17,18 act perpendicularly on a pair of upper and lower reactive fins or plates 21, 22 (FIG. 2) on the window frame 12 so as to displace the sashes 13, 14 perpendicularly to their planes, thereby pressing the sashes 13, 14 against the frame 12 for an increased degree of sealing therebetween.

Figure 3:
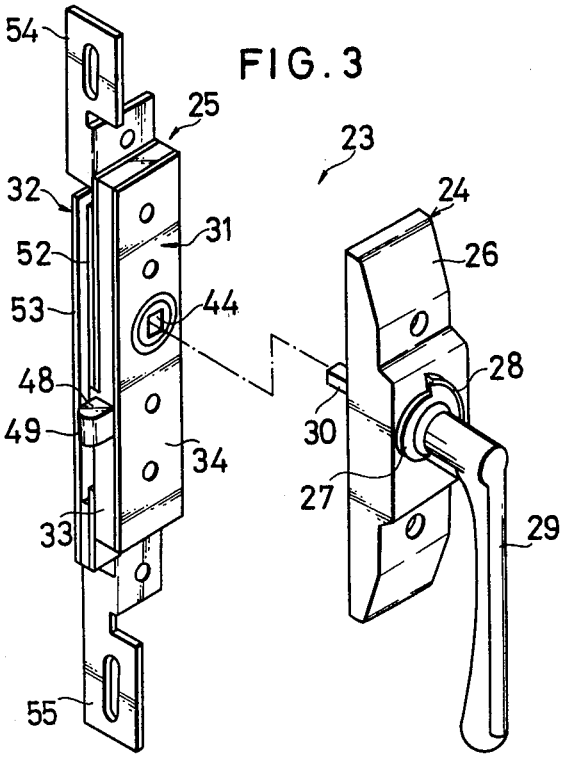
FIG. 3 is a partly exploded perspective view of the latch.
Figure 4:
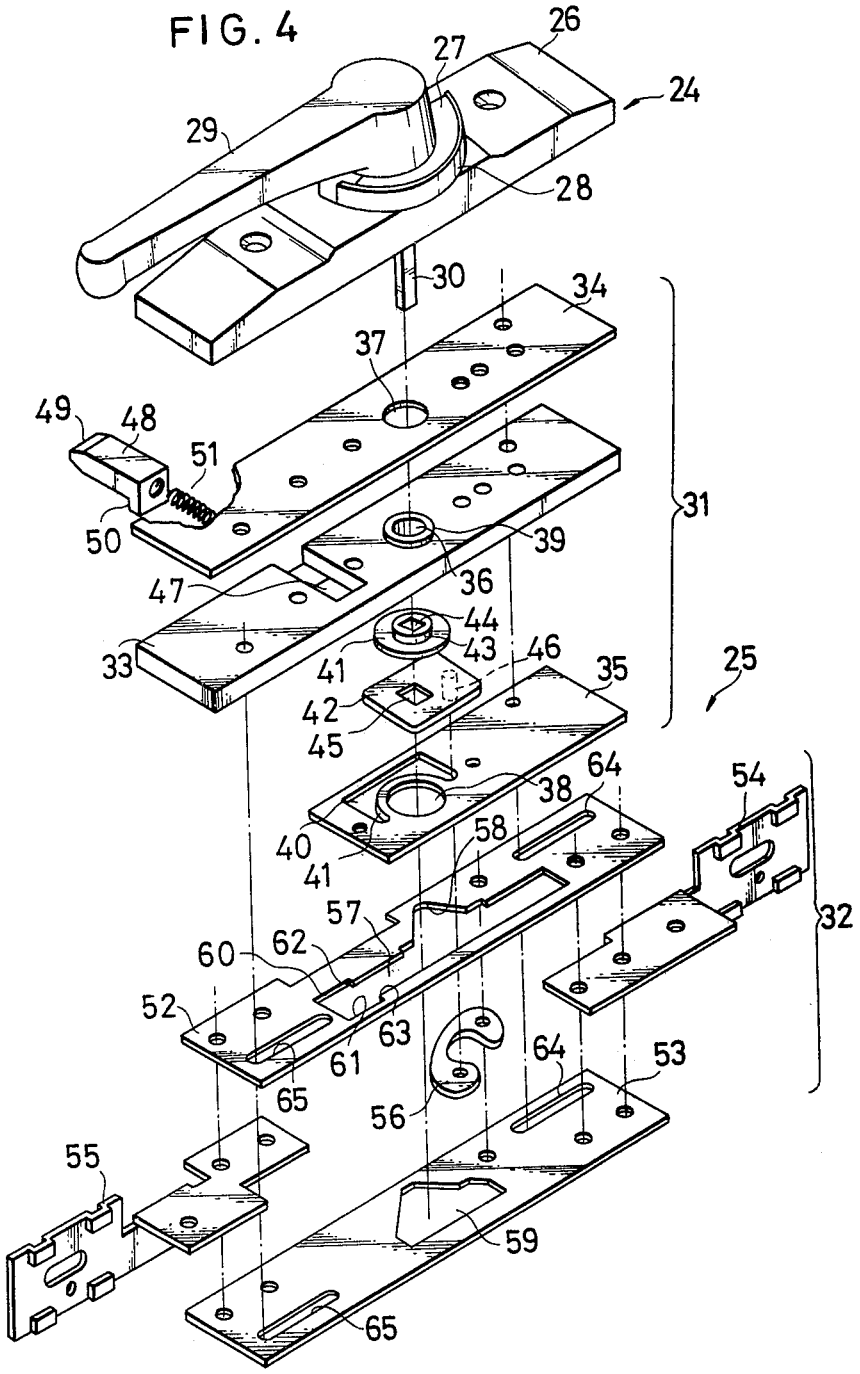
FIG. 4 is a fully exploded perspective view of the latch.

As shown in FIGS. 3 and 4, the latch 10 includes a latch cam assembly 23 having a latch cam unit 24 disposed on an end face of the vertical meeting stile 16 and a control mechanism 25 disposed in the interior of the vertical meeting stile 16. The latch cam unit 24 has a mount 26 fixed to the meeting stile 16, a latch cam 27 rotatably mounted on the mount 26 and including a crescent-shaped cam projection 28, and a handle 29 fixed to the latch cam 27 and having an actuator shaft 30 of noncircular cross-section, here of square cross-section. The control mechanism 25 generally comprises a fixed unit 31 fixedly mounted on the meeting stile 16 and a movable unit 32 that is vertically movable in the meeting stile 16 in response to turning of the actuator shaft 30.

The fixed unit 31 (FIG. 4) comprises an elongate base plate or casing 33, preferably of synthetic resin, an attachment cover plate 34 overlying the base plate 33, and a guide plate 35 underlying the base plate 33. The base plate 33, the cover plate 34, and the guide plate 35 have circular openings 36, 37 and 38, respectively held in register with one another. The actuator shaft 30 extends with clearance through the circular openings 36, 37 and 38. The base plate 33 has an annular flange 39 projecting therefrom and disposed in surrounding relation to the circular opening 36, the annular bearing flange 39 fitting in the opening 37 in the cover plate 34. The guide plate 35 has a guide hole 40 having a semicircular guide edge 41 extending around the circular opening 38.

Between the base plate 33 and the guide plate 35, there are disposed a bearing disc plate 41 and a crank plate 42. The disc plate 41 has a coaxial cylindrical projection 43 and a through hole 44 of noncircular or square cross-section extending axially through the cylindrical projection 43. The cylindrical projection 43 is rotatably fitted in the circular opening 36 in the base plate 33. The disc plate 41 is preferably made of synthetic resin so as to be smoothly rotatable or angularly movable with respect to the base plate 33. The crank plate 42 has a noncircular or square hole 45 held in axial alignment with the square hole 44 in the disc plate 41. The crank plate 42 also has an eccentric pin 46 that projects into the guide hole 40 in the guide plate 35. The actuator shaft 30 slidably fits in the square holes 44, 45 so that the disc plate 41 and the crank plate 42 can corotate with the rotation of the actuator shaft 30. Accordingly, the pin 46 on the crank plate 42 is movable along the semicircular guide edge 41 between diametrically opposite limits across the circular opening 38, in response to the angular movement of the handle 29.

The base plate 33 has a transverse slot 47 opening at one side edge of the base plate 33. An elongate locking feeler 48 preferably of synthetic resin is slidably disposed in the slot 47. The locking feeler 48 has a tapered feeler end 49 projecting sideways beyond said one side edge of the base plate 33, and a locking flange 50 projecting downwardly as shown in FIG. 4, into coaction with the movable unit 32. A helical compression spring 51 is disposed in the transverse slot 47 and acts on the locking feeler 48 so as to urge the tapered feeler end 49 outwardly away from the base plate 33.

The movable unit 32 comprises a pair of upper and lower elongate slide plates 52, 53, a pair of joint members 54, 55 each connected at one end to and sandwiched between the slide plates 52, 53 and having an interfitting profile at the other end for connection to the rods 19, 20, respectively, and a link member 56 pivotally mounted between the slide plates 52, 53. The upper illustrated slide plate 52 has an elongate opening 57 extending in the longitudinal direction of the slide plate 52, the opening 57 including a central bay 58 corresponding in position to the guide hole 40 in the guide plate 35. The lower slide plate 53 has a central opening 59 which corresponds positionally to the central bay 58 in the upper slide plate 52. A pair of transverse recesses 60, 61 are disposed at opposed longitudinal edges of the elongate opening 57 in the upper slide plate 52. The recesses 60, 61 open in opposed relation toward each other and are located below the transverse slot 47 in the base plate 33. A pair of transverse shoulders 62, 63 is defined by the recesses 60,61, respectively. The link member 56 is pivotally connected at one end to the upper and lower slide plates 52,53 and at the other end to the pin 46 on the crank plate 42.

Each of the upper and lower slide plates 52,53 has a pair of longitudinal slots 64,65 located adjacent to end portions thereof.

The fixed unit 31 and the movable unit 32 are coupled together by means of a pair of pins 66,67 (FIGS. 7 through 9), the pin 66 extending through the slots 64 in the slide plates 52,53 and through the guide plate 35, the base plate 33, and the cover plate 34. The pin 67 extends through the slots 65 in the slide plates 52,53 and through the base plate 33 and the cover plate 34. Accordingly, the slide plates 52,53 are longitudinally movable relatively to the fixed unit 31 by a distance determined by the length of the slots 64,65.

As illustrated in FIGS. 5 and 6, the latch 10 also includes a cam keeper 68 fixed to the meeting stile 15, the cam keeper 68 having a hook-shaped detent 69. The meeting stile 16 has a hole 70 through which the locking feeler 48 projects outwardly of the meeting stile 16.

Figure 2:
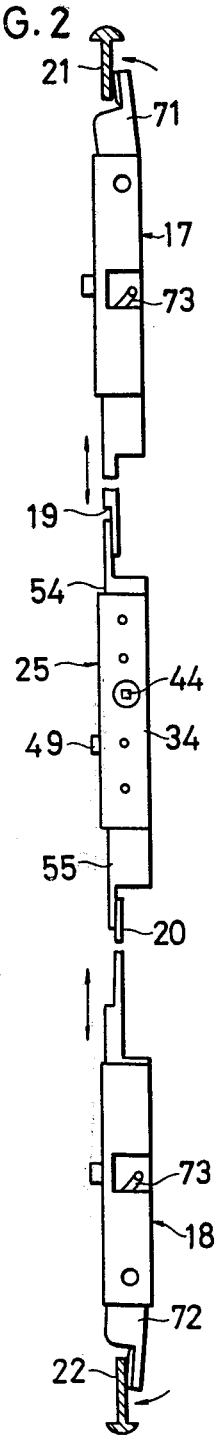
FIG. 2 is an enlarged front elevational view of the latch associated with window shifting means.

The window shifting devices 17,18 of FIG. 2 comprises a pair of pivotable pressers 71,72, which are actuatable for coaction with the reactive plates 21,22, respectively, of the frame 12 in response to vertical movement of the rods 19,20 when the handle 29 is turned to move the slide plates 52,53 vertically. Each of the window shifting devices 17,18 includes a mechanism 73 such as a pin and slot for converting straight-line motion of the rod 19 or 20 to angular motion of the presser 71 or 72.

Figure 7:
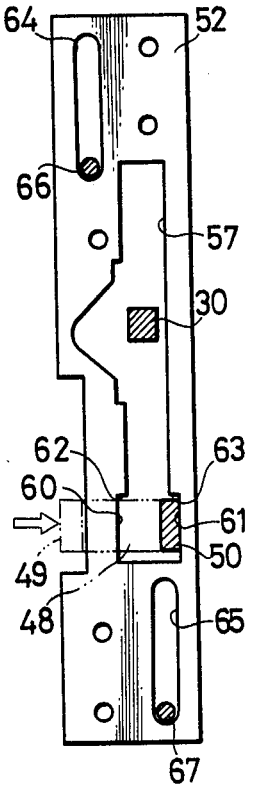
FIGS. 7 through 9 are elevational views of the interior of the latch, showing three functional positions of the locking feeler.

The latch cam assembly 23 is attached to the meeting stile 16 as follows: the control mechanism 25 as it is put together is inserted into the interior of the meeting stile 16 with the locking feeler 48 projecting through the hole 70. The control mechanism 25 is screwed to the meeting stile 16. Then, the locking feeler 48 is pushed into the meeting stile 16 against the bias of the spring 51. With the movable unit 32 being out of a proper starting or initial position at this time, the transverse recess 61 is out of alignment with the locking feeler 48, and thus the locking feeler 48 cannot fully be withdrawn into the meeting stile 16. The actuator shaft 30 of the latch cam unit 24 is inserted through an opening in the meeting stile 16 into the square holes 44,45 in the crank plate 42 and the guide plate 35, respectively. The actuator shaft 30 is turned to move the movable unit 32 vertically until the locking feeler 48 is aligned with and received in the transverse recess 61 as shown in FIG. 7 whereupon the movable unit 32 is in its proper initial position. Then, the rods 19,20 are adjusted so as to place the pressers 71,72 in their unactuated positions and are connected to the joint members 54,55, respectively. Finally, the latch cam unit 24 is fastened to the meeting stile 16 with the handle 29 in its preferred initial position.

Figure 8:
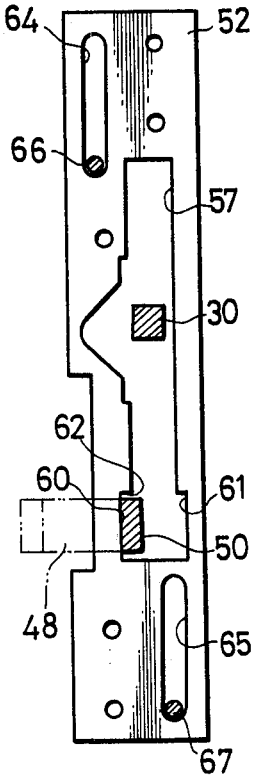

When the window sashes 13,14 are not in their closed position as shown in FIG. 5, the locking feeler 48 projects outwardly under the force from the spring 51 with the locking flange 50 seated in the recess 60 in the slide plate 52 (FIG. 8). Any attempt to turn the handle 29 in such a sash-unclosed position fails because the shoulder 62 will engage the locking flange 50, thereby preventing the slide plate 52 from being moved downwardly. Accordingly, as long as the sashes 13,14 remain unclosed, the handle 29 cannot be turned and the crescent-shaped cam projection 28 is held back out of a collision path with the cam keeper 68 and the meeting stile 15.

Figure 9:
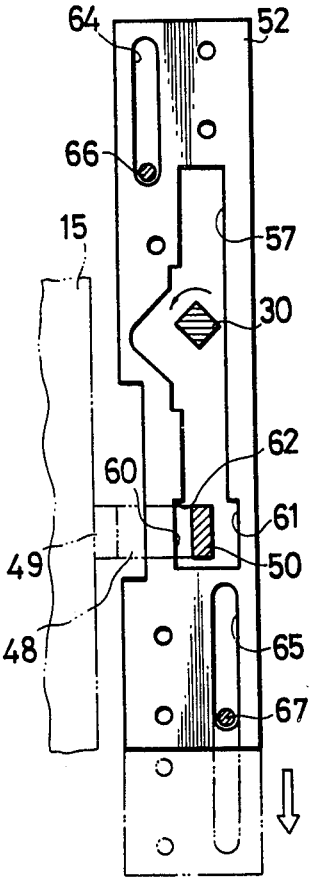
Figure 10:
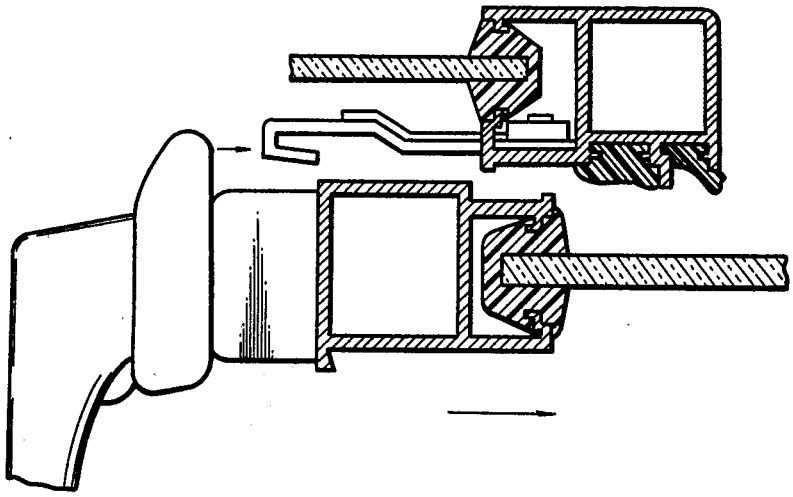
FIG. 10 PRIOR ART
FIG. 10 is a horizontal cross-sectional view of a pair of window meeting stiles, illustrating a conventional latch.

When the sashes 13,14 are fully closed, the feeler end 49 engages the meeting stile 15 and the locking feeler 48 is pushed back against the bias of the spring 51 as illustrated in FIGS. 6 and 9. Retraction of the locking feeler 48 into the interior of the meeting stile 16 causes the locking flange 50 to move out of the recess 60, whereupon the shoulder 62 finds no obstruction in its way. With the locking flange 50 being located substantially centrally in the opening 57, the movable unit 32 is free to move downwardly in response to actuation of the handle 29. Then, the handle 29 is turned to angularly move the latch cam 27 until the cam projection 28 slides into latching engagement with the hook-shaped detent 69 of the cam keeper 68.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A window latch for acting between a pair of first and second meeting window stiles, comprising:
   (a) a base plate adapted to be mounted on the first stile;
   (b) a cam keeper adapted to be attached to the second stile;
   (c) latch cam means adapted to be rotatably mounted on the first stile for locking engagement with said cam keeper;
   (d) a slide plate movably mounted on said base plate and having first engaging means;
   (e) means operatively connected to said latch cam means and said slide plate for moving said slide plate in a first direction in response to turning of said latch cam means; and
   (f) locking means supported on said base plate and having second engaging means normally engaging said first engaging means for preventing movement of said slide plate and turning of said latch cam means, said locking means being movable in a second direction transverse to said first direction in response to the engagement thereof with the second stile, for allowing said second engaging means to disengage from said first engaging means.

2. A window latch according to claim 1, said slide plate being movable in the longitudinal direction of the first stile.

3. A window latch according to claim 1, said latch cam means comprising a cresent-shaped cam projection for slidable locking engagement with said cam keeper, a handle mounted on said cam projection, and an actuator shaft of a noncircular cross-section mounted on said cam projection, said cam projection being corototable with said actuator shaft, and said slide plate moving means including crank means connected to said actuator shaft.

4. A window latch according to claim 3, said crank means comprising a crank plate having a hole complementary in shape to said noncircular cross-section and through which said actuator shaft extends, a pin fixed to said crank plate in eccentric relation to said hole, and coupling means operatively connecting said pin to said slide plate.

5. A window latch according to claim 3, said base plate having a hole through which said actuator shaft extends, including bearing means disposed between said base plate and said crank means, and having a hole complementary in shape to said noncircular cross-section, said actuator shaft extending through said last-mentioned hole.

6. A window latch according to claim 5, said bearing means comprising an annular member having a coaxial cylindrical portion with said last-mentioned hole therein, said cylindrical portion being rotatably disposed in the hole in said base plate.

7. A window latch according to claim 1, said slide plate having a slot elongated in said first direction and a recess opening into said slot, said first engaging means comprising a shoulder defined by said recess, said base plate having a groove extending in said second direction, said locking means comprising an elongate member slidably disposed in said groove and having a locking flange extending into said slot in said slide plate, and spring means acting between said base plate and said elongate member for normally urging said elongate member into the path of the second stile with said locking flange engaging said shoulder, whereby said locking flange is movable out of engagement with said shoulder into said slot in response to the displacement of said elongate member by the second stile against the bias of said spring means.

8. A window latch for acting between a pair of first and second meeting stiles of a pair of first and second window sashes, respectively, movable in a window frame, said first window sash having means for engaging the window frame to shift the first and second window sashes sideways against the window frame for an increased degree of sealing, said window latch comprising:
   (a) a base plate adapted to be mounted on the first stile;
   (b) a cam keeper adapted to be attached to the second stile;
   (c) latch cam means adapted to be rotatably mounted on the first stile for locking engagement with said cam keeper;
   (d) a slide plate movably mounted on said base plate and having first engaging means;
   (e) joint members coupled with said slide plate for actuating the window sash engaging means in response to movement of said slide plate;
   (f) means operatively connected to said latch cam means and said slide plate for moving said slide plate in a first direction in response to turning of said latch cam means; and
   (g) locking means supported on said base plate and having second engaging means normally engaging said first engaging means for preventing movement of said slide plate and turning of said latch cam means, said locking means being movable in a second direction transverse to said first direction in response to the engagement thereof with the second stile, for allowing said second engaging means to disengage from said first engaging means.

9. A window latch according to claim 8, said slide plate having a slot elongated in said first direction and a recess opening into said slot, said base plate having a groove extending in said second direction, said locking means comprising an elongate member slidably disposed in said groove and having a flange extending into said slot in said slide plate, and spring means acting between said base plate and said elongate member for normally urging said flange out of said recess, said elongate member being movable into said recess against the bias of said spring means for enabling the positional relationship between said slide plate and said base plate to be established.

10. A window latch according to claim 7 or 9, said slide plate having another recess opening into said slot for receiving said locking flange when it is fully pushed back.

11. A window latch for locking together a pair of slidable window sashes in closed position, comprising:

(a) a cam keeper adapted to be secured to a first of said sashes;

(b) a latch assembly adpated to be secured to a second of said sashes and including a manually movable cam interengageable with said keeper; and (c) means slidably supported on said latch assembly, and disposed to be automatically responsive to the absence of the first of said sashes, for inhibiting manual movement of said cam when the sashes are not closed, said inhibiting means including (d) a slide plate arranged to move linearly in a first direction in response to rotational movement of said cam, said slide plate having an elongated slot with a recess opening into it in a direction away from the first of said sashes, and (e) a feeler having an end normally disposed in the path of the first of said sashes with a remote portion of said feeler disposed in said recess to block its movement, said feeler being movable out of said path and out of said recess in response to the closing of the sashes.

12. A window latch for locking together a pair of slidable window sashes in closed position, comprising:

(a) a cam keeper adapted to be secured to a first of said sashes;

(b) a latch assembly adapted to be secured to a second of said sashes and including a manually movable cam interengageable with said keeper; and (c) means slidably supported on said latch assembly, and disposed to be automatically responsive to the absence of the first of said sashes, for inhibiting manual movement of said cam when the sashes are not closed, said inhibiting means including (d) a slide plate arranged to move linearly in a first direction in response to rotational movement of said cam, said slide plate having an elongated slot with a recess opening into it, and (e) a feeler having a remote portion positionable in said recess for identifying the position that said slide plate should be in when said cam is in a position disengaged from said cam keeper.

* * * * *